US006443998B1

(12) United States Patent
Jones

(10) Patent No.: US 6,443,998 B1
(45) Date of Patent: Sep. 3, 2002

(54) TRICHROMATIC FIBER DYEING PROCESSES AND COMPOSITIONS THEREOF

(75) Inventor: Dennis Jones, Dalton, GA (US)

(73) Assignee: Shaw Industries, Inc., Dalton, GA (US)

( * ) Notice: Subject to any disclaimer, the term of this patent is extended or adjusted under 35 U.S.C. 154(b) by 0 days.

(21) Appl. No.: 09/550,484

(22) Filed: Apr. 14, 2000

(51) Int. Cl.[7] ..... C09B 67/22; D06P 67/24

(52) U.S. Cl. ..... 8/638; 8/404; 8/436; 8/438; 8/636; 8/637; 8/639

(58) Field of Search ..... 8/436, 438, 636, 8/637.1, 638, 639, 404

(56) References Cited

U.S. PATENT DOCUMENTS

| | | | | | |
|---|---|---|---|---|---|
| 3,619,122 | A | * | 11/1971 | De Maria | 8/173 |
| 4,537,598 | A | | 8/1985 | Schaetzer et al. | 8/641 |
| 4,579,561 | A | | 4/1986 | Rowe et al. | 8/641 |
| 4,678,476 | A | | 7/1987 | Tappe et al. | 8/639 |
| 4,725,849 | A | * | 2/1988 | Koike et al. | 346/1.1 |
| 4,840,643 | A | | 6/1989 | Rowe | 8/641 |
| 4,979,962 | A | * | 12/1990 | Grychtol et al. | 8/436 |
| 5,092,905 | A | | 3/1992 | Doré | 8/638 |
| 5,096,460 | A | | 3/1992 | Mausezahl | 8/641 |
| 5,399,183 | A | | 3/1995 | Adam | 8/641 |

* cited by examiner

*Primary Examiner*—Yogendra N. Gupta
*Assistant Examiner*—Eisa Elhilo
(74) *Attorney, Agent, or Firm*—Needle & Rosenberg P.C.

(57) ABSTRACT

In one aspect, the invention provides a process for the trichromatic dyeing of polyamide textile fibers wherein the process comprises the steps of:

a. providing at least one polyamide fiber; and b. contacting the at least one polyamide fiber with an aqueous dye solution comprising a yellow component, a red component and a blue component, wherein the yellow component comprises a mixture of Acid Orange 156 and Acid Yellow 199 thereby providing a dyed fiber. In a further aspect, the invention provides compositions for the trichromatic dyeing of polyamide fibers.

21 Claims, No Drawings

TRICHROMATIC FIBER DYEING PROCESSES AND COMPOSITIONS THEREOF

SUMMARY OF THE INVENTION

The invention relates to processes for the trichromatic dyeing of polyamide textile fibers. The invention further pertains to compositions useful for the trichromatic dyeing of polyamide fibers.

BACKGROUND OF THE INVENTION

Dyestuffs are commonly utilized in a combination of three primary colorants e.g., red yellow and blue, to provide the majority of the shades most often utilized to dye textile, specifically polyamide, fibers. Such a three dye combination is known as a "trichromy" and the related dyeing processes are known as "trichromatic dyeing." In formulating trichromatic dyeing formulations, the dye selection may focus on the specific dyes which will provide the most uniform dyeing rates. That is, it is usually desirable for the exhaustion rates for the red, yellow and blue dyes to be comparable so that the dye take up will be fairly uniform for each of the colors.

Manufacturers of dyestuffs often supply dyes to textile manufacturers in pure product form. Pure forms of dyestuffs are classified for identification by Color Index (CI) number. This system was developed by the American Association of Textile Chemists and Colorists (AATCC) to allow more uniform identification of dyestuff identity to the end user. Such dyes are sometimes called "standards." While pure dyes have some application for the dyeing of polyamide fibers, it is not uncommon for such pure dyestuffs to provide inferior dyeing performance in trichromatic dyeing processes.

Manufacturers also supply dyes in mixtures of pure forms. Mixtures may be preferable to the pure form of the dyestuffs for reasons related to the shade desired and/or performance properties. For example, a mixture of CI Acid Red 337 and CI Acid Red 426 provides a bluish red acid dye mixture that has similar dyeing behavior in composition to CI Acid Red 337 when used as the red component in typical dyeing systems for nylon, but the mixture of CI Acid Red 337 and CI Acid Red 426 can provide improved lightfastness as compared to dyeings using the Acid Red 337 alone as the red component.

In selecting dyes for use in trichromatic dyeing, it is important that the color components be sufficiently compatible from a performance standpoint to allow them to effectively dye polyamide fibers in a trichromatic system. Such compatibility preferably relates to those dyes that provide uniform strike, build and exhaustion during the dyeing operation and to be able to reproduce the coloration in a consistent manner from batch to batch. Moreover, it can be exceedingly difficult to predict the particular performance of a dye, especially when the dye is combined with other dyes in a trichromatic process. Additionally, even though the performance of the dyed fiber may be initially acceptable, it has been seen that application of a stain resist chemical may reduce the lightfastness of the dyed fiber.

In light of the above, it would be desirable to develop a trichromatic dyeing process which utilizes a yellow component that provides both excellent build properties and lightfastness characteristics. Furthermore, it would be desirable to develop a trichromatic dyeing process which provides such improvements in lightfastness even when a stainblocking chemical is applied to the dyed fiber.

SUMMARY OF THE INVENTION

In one aspect, the invention provides a process for the trichromatic dyeing of polyamide textile fibers wherein the process comprises the steps of:

a. providing at least one polyamide fiber; and b. contacting the at least one polyamide fiber with an aqueous dye solution comprising a yellow component, a red component and a blue component, wherein the yellow component comprises. a mixture of Acid Orange 156 and Acid Yellow 199, thereby providing a dyed fiber.

In a further aspect, the invention provides compositions for the trichromatic dyeing of polyamide fibers.

Additional advantages of the invention will be set forth in part in the description that follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DETAILED DESCRIPTION OF THE PREFERRED EMBODIMENTS

The present invention may be understood more readily by reference to the following detailed description of preferred embodiments of the invention and the Examples included herein.

It must be noted that, as used in the specification and the appended claims, the singular forms "a," "an" and "the" include plural referents unless the context clearly dictates otherwise. Thus, for example, reference to "an aromatic compound" includes mixtures of aromatic compounds, reference to "a carrier" includes mixtures of two or more such carriers, and the like.

Ranges are often expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment.

A weight percent of a component, unless specifically stated to the contrary, is based on the total weight of the formulation-or composition in which the component is included. Further, unless otherwise noted, weight percents are expressed as dry weight.

Unless otherwise stated, the dye names set forth herein conform to the dyes listed in the Colour Index International, 3$^{rd}$ Ed., published by The Society of Dyers and Colourists. One of ordinary skill in the art will recognize that this publication generally serves to define the standard names for dyes utilized in the textile industry.

Throughout this document, where publications are referenced, the disclosures of these publications in their entireties are hereby incorporated by reference in order to more fully describe the state of the art to which this invention pertains.

In a first embodiment, the invention provides a process for the trichromatic dyeing of polyamide textile fibers wherein the process comprises the steps of: a) providing at least one polyamide fiber; and b) contacting the at least one polyamide fiber with an aqueous dye solution comprising a yellow component, a red component and a blue component, wherein the yellow component comprises a mixture of Acid Orange 156 and Acid Yellow 199, thereby providing a dyed fiber. It has surprisingly been found that by utilizing this particular mixture of dyes, superior trichromatic build performance and costs savings can be obtained over any single dye or mixture of dyes utilized as the yellow component in the prior art. Furthermore, it has been surprisingly discovered that markedly improved lightfastness can result over dyeing processes that utilize other yellow components.

The red and blue dye components which are suitable for use in combination with the yellow component of the present invention include any red and blue dyes which are at least partially compatible with the desired yellow component. To this end, compatibility can be readily determined by interrupting the dyeing process and examining the color build characteristics of the partially dyed fiber. As such, the determination of compatibility between various dyes would be a matter of routine experimentation to those skilled in the art.

Preferably, the blue component comprises one or more of a dye selected from the group consisting of: Acid Blue 25; Acid Blue 40; Acid Blue 41, Acid Blue 78; Acid Blue 129; Acid Blue 205; Acid Blue 260; Acid Blue 277; Acid Blue 288; Acid Blue 324; Acid Green 25, or a mixture thereof In a particularly preferred embodiment, the blue component comprises Acid Blue 324.

Preferably, the red component comprises one or more of a dye selected from the group consisting of: Acid Red 42; Acid Red 57; Acid Red 257; Acid Red 266; Acid Red 337; Acid Red 361; Acid Red 396; Acid Red 426, or a mixture thereof. In a particularly preferred embodiment, the red component comprises Acid Red 337, Acid Red 426, Acid Red 361, or a mixture thereof.

Optionally, the yellow component in the trichromatic processes herein can further include one or more of dyes selected from the group consisting of Acid Yellow 49; Acid Yellow 135; Acid Yellow 159; Acid Yellow 159:1; Acid Yellow 174; Acid Yellow 198; Acid Yellow 216; Acid Yellow 219:1; Acid Yellow 230; Acid Yellow 240; Acid Orange 47; Acid Orange 67; Acid Orange II16; Acid Orange 152, or a mixture thereof.

In one preferred embodiment of the invention herein, the yellow component comprises from about 80 parts to about 20 parts of the Acid Orange 156 and from about 80 parts to about 20 parts of the Acid Yellow 199 to provide 100 total parts dye in the yellow component. In a further embodiment, the yellow component comprises from about 60 parts to about 40 parts of the Acid Orange 156 and from about 60 parts to about 40 parts of the Acid Yellow 199 to provide 100 total parts dye in the yellow component. This particular mixture of Acid Orange 156 and Acid Yellow 199 is referred to herein as "Orange TC." In a further embodiment, the yellow component comprises from about 45 parts to about 55 parts of the Acid Orange 156 and from about 45 parts to about 55 parts of the Acid Yellow 199 to provide 100 total parts dye in the yellow component. In a still further embodiment, the yellow component comprises from about 48 parts to about 52 parts of the Acid Orange 156 and from about 48 parts to about 52 parts of the Acid Yellow 199 to provide 100 total parts dye in the yellow component. In another embodiment, equal parts of Acid Orange 156 to Acid Yellow 199 are utilized. In accordance with the methods and compositions herein, it has been found that the preferred ratios of these dyes making up the Orange TC dye mixture preferably does not vary based on desired depth of shade or the target color of the polyamide fiber to be dyed.

In making the dye baths for use in the present invention, the red, blue and yellow dye components are introduced into an aqueous solution by techniques well recognized in the art. For example, the dyes, in powder form, can be introduced into water to provide the desired solution. The amount of yellow, red and blue components employed in the dye bath is dependent on desired color of the dyed fiber and, as such, optimization would be within the purview of those skilled in the art. Preferably, the amount of the components employed in the aqueous solution is selected to provide a dye take up (based on 100% exhaustion) of about 0.0001% of (on weight fiber) to about 2.0% owf for each of the yellow, red and blue components. More preferably, in dyeing nylon 6 or 66 fibers, the amount of the preferred yellow component, comprising a combination of Acid Yellow 199 and Acid Orange 156, is about 0.01 to about about 0.03% owf with the blue component being about 0.03% owf to about 0.05% owf and the red component being about 0.01% owf to about 0.03% owf.

The aqueous dye solution can further comprise one or more of a wetting agent, a buffering agent, a lightfastness enhancing agent and a water treatment agent. Still further, the invention further provides treating the dyed fiber with a stainblocking agent, wherein the stainblocking agent is applied at a pH of from about 0.5 to 3.0. In a further embodiment, the stainblocking agent may be applied at a pH of 0.5, 1.0, 1.5, 2.0, 2.5, or 3.0. In accordance with the methods herein, it has been surprisingly found that with the Orange TC as a yellow component, lightfastness of a trichromatic dyed fiber can be improved even when a stainblocking agent is utilized. The choice of a particular stainblocking agent is dependent of the particular fiber being treated. For example, in treating nylon, suitable agents include FX657 from 3M and SR500 from DuPont.

Moreover, the selection of, and amounts for, each of the additional agents would be dependent on the particular dye bath/fiber combination and the need for the relative function of the particular agent in question. As such, determination of optimal amounts for each agent would be within the purview of those skilled in the art.

The dye solutions according to the present invention can be employed in dyeing any polyamide fiber recognized in the art. Specific examples of suitable fibers include polyamide textile fibers of nylon 6 and nylon 66. Moreover, the dye solution finds particular utility in dyeing fibers used in forming carpets and carpet products.

In this regard, the dye solution can be used in connection with both continuous and batch dyeing processes and can include any process recognized in the art. Although such processes are known in the art and as such need not be described in detail here, the following information regarding certain suitable processes is provided for sake of completeness.

For example, the processes may be conducted in a continuous dyeing processes. In a non-exclusive list, the following steps may be conducted in accordance with the continuous dyeing processes contemplated herein: (a) a polyamide fiber is sewed onto a backing to provide a dyeable material; (b) the lint is extracted; (c) the material is passed through a web guider; (d) the material is passed through a pre-steamer; (e) the material is pre-wet and/or extracted; (f) the material is passed through a dye applicator (Kusters Fluldyer, Fleissner overflow applicator); (g) the material is passed through a vertical steamer; (h) the material is rinsed and/or extracted; (i) stainblocking application (Kusters Flexnip or Kusters Fluicon); 0) the material is passed through a web guider; (k) the material is passed through a vertical steamer; (1) the material rinsed and/or extracted; (m) a fluorochemical (via spray bar, or foam applicator) is applied; (n) the material is passed through a dryer and/or tenter; (o) the material is cooled; and (p) the material is cut and accumulated. One of ordinary skill in the art will recognize that a number of the steps enumerated previously may be omitted or are optional and also that the steps need not necessarily be performed in the stated order.

In a further embodiment, the batch dyeing processes may be utilized. One of ordinary skill in the art will recognize that batch (or exhaust) dyeing refers to a process by which colorants are applied to a substrate using a closed system. In a typical embodiment of a preferred batch dyeing process, the substrate to be colored, along with the colorants, auxiliary chemicals (including stainblocker), and medium for colorant transfer (usually water) are each added to a closed vessel. The vessel and contents are then heated using the appropriate time and temperature profile that will allow exhaustion of the colorants onto the substrate in a uniform fashion, so that a level dyeing results. In the case of nylon, which can be dyed at temperatures below the boiling point of water, the vessel can be open to the atmosphere. When higher temperatures must be utilized, the vessel can be designed to allow pressurization. In a preferred embodiment of the batch dyeing method, the liquor to goods ratio is from about 10:1 to about 80:1, with aparticularly preferred ratio being from about 15:1 to about 25:1.

In yet a further embodiment, the fibers may be skein dyed. In accordance with this method, skeins of carpet yam are mounted on a holding device. The holding device is then lowered into a rectangular vessel containing the dyebath.

Still further, the invention provides compositions for dyeing polyamide fibers.

EXAMPLES

The following Examples are set forth so as to provide those of ordinary skill in the art with a complete disclosure and description of how the compounds and methods claimed herein are made, performed and evaluated, and are intended to be purely exemplary of the invention and are not intended to limit the scope of what the inventors regard as their invention. Efforts have been made to ensure accuracy with respect to numbers (e.g., amounts, temperature, etc.) but some errors and deviations should be taken into account. Unless indicated otherwise, parts are parts by weight, temperature is in ° C. or is at room temperature, and pressure is at or near atmospheric.

Example 1

Daebath Composition for Coloration of Nylon Carpet Fibers

A dyebath for t he coloration of polyamide carpet fibers consisted of the following components:

a. Water, sufficient to obtain a delivery rate of4 parts of dyebath to every one part of fiber or carpet on a weight basis (i.e., about 400% wet pick-up).

b. Sodium Thiosulfate—0.05 grams per liter of bath (optional)

c. EDTA—0.25 g/l -(optional)

d. Sodium hexameta phosphate—0.25 g/l (optional)

e. 5% reacted silicone bas e defoamer—0.25 g/l to control foaming in the steamer. (Dow Coming, Midland, Mich.)

f. Wetting/leveling agent—2 g/l to 4 g/l, depending on fiber type and carpet construction (DOSS 70 (Manufacturer's Chemical, Dalton, Ga.), CX HC (Clarient, Charlotte, N.C.), DDBSA (Stepan, Northbrook, Ill.), Dowfax 2A4 (Dow Chemical, Midland, Mich.) are typical products that are used for this purpose).

g. Acids/Buffers for pH control (optional—the bath pH is typically adjusted to 6.5 for light to medium shade depths and 5.0 for darker depths (typical products utilized for this purpose are MSP/TSP, Ammonium Sulfate, Phosphoric Acid, Acetic Acid).

Example 2

Batch Dyeing Process

In an example of the batch (or exhaust) dyeing processes for nylon carpet and yams, a rectangular shaped steel vessel with a 7000 gallon capacity was utilized to allow carpet lengths of up to 600 feet to be dyed (load weights are in the range of 1800 pounds). A drive reel was used to move the carpet substrate through the dyebath to achieve a uniform distribution of dyestuffs on the substrate. The contents of the dyebath used were similar to those described above in Example 1 for the continuous

Example 3

Trichromatic Build/Lightfastness Comparisons or Various Nylon Substrates

A study of the trichromatic build and lightfastness characteristics was performed for a number of types of polyamide fibers as set forth below in Table 1. The fibers were dyed with the dye combinations described in Tables 4 and 5. Table 4 sets forth the build and lightfastness results for the particular dyed polyamide fibers. Table 5 sets forth the results of xenon lightfastness tests for polyamide fibers treated with various stain blockers at two different pH's.

TABLE 1

FIBERS UTILIZED IN TRICHROMATIC DYEING TESTS

| FIBER TYPES | DESCRIPTION | MANU-FACTURER | LOCATION |
|---|---|---|---|
| 1341 FS | Nylon 6 Filament 1300 denier, Superba set | Shaw Industries, Inc. | Dalton, GA |
| 1126 FS | Nylon 6 Filament 1100 denier, Superba set | Allied (now Honeywell) | Petersburg, VA |
| 1392 Sup Tex | Nylon 6 Filament 1400 denier, Superba set with Texture | Allied (now Honeywell) | Petersburg, VA |
| 1500 FS | Nylon 6 Filament 1500 denier, Superba set | Allied (now Honeywell) | Petersburg, VA |
| 1388 Sup Tex | Nylon 6 Filament 1400 denier, Superba set with texture, delustered | Allied (now Honeywell) | Petersburg, VA |
| 1530 Sup Tex | Nylon 6 Filament 1500 denier, Superba set with texture, delustered | Shaw Industries, Inc. | Dalton, GA |
| AT312 Sue | Nylon 6 Staple 2.50's count, Suessen set | Allied (now Honeywell) | Petersburg, VA |
| S1341 Sue | Nylon 6 Filament 1300 denier, Suessen set | Shaw Industries, Inc. | Dalton, GA |
| D1365 Sup | Nylon 66 Filament 1300 denier, Superba set, delustered | DuPont | Wilmington, DE |
| S1838 Sup | Nylon 66 Staple 2.75's count, Superba set, producer applied fluorine | Solutia | Pensacola, FL |

TABLE 1-continued

FIBERS UTILIZED IN TRICHROMATIC DYEING TESTS

| FIBER TYPES | DESCRIPTION | MANU-FACTURER | LOCATION |
|---|---|---|---|
| S1090 FS | Nylon 66 filament 1100 denier, Superba set | Solutia | Pensacola, FL |
| D1125FS | Nylon 66 filament 1100 denier, Superba set, delustered | DuPont | Wilmington, Delaware |
| S1670 Sue | Nylon 66 Staple 2.75's count, Suessen set, producer applied fluorine | Solutia | Pensacola, FL |
| S1838 Sue | Nylon 66 Staple 2.75's count, Suessen set, producer applied fluorine | Solutia | Pensacola, FL |
| S1993 Sue | Nylon 66 Staple 3.25's count, Suessen set, delustered | Solutia FL | Pensacola, |

The dyes utilized in the trichromatic dyeing tests were as set out in Table 2.

TABLE 2

DYES UTILIZED IN TRICHROMATIC DYEING TESTS

| DYES | DESCRIPTION | MANU-FACTURER | LOCATION |
|---|---|---|---|
| Y199 | Acid Yellow 199 | Dystar | Frankfurt, Germany |
| R361 | Acid Red 361 | Ciba Specialty Chemicals | St. Gabriel, LA |
| B324 | Acid Blue 324 | Dystar | Frankfurt, Germany |
| YKFRL | Blend of Acid Yellow 230 and Yellow 199 | Dystar | Frankfurt, Germany |
| R2BN | Blend of Acid Red 337 and Acid Red 426 | Dystar | Frankfurt, Germany |
| ORANGE TC | Blend of Acid Orange 156 and Acid Yellow 199 | Shaw Industries, Inc. | Dalton, GA |

The dye ratios utilized in the trichromatic dyeing tests are set out in Table 3:

TABLE 3

DYE RATIOS UTILIZED IN TRICHROMATIC DYEING TESTS

| DYE MIXTURE (powder) | DYE STRENGTH | % OWF (on weight fiber) |
|---|---|---|
| Y199/R361/B324 | 150/200/200 | 0.0370/0.0210/0.0400 |
| Orange TC/R361/B324 | 200/200/200 | 0.0240/0.0210/0.0400 |
| YKFRL/R2BN/B324 | 200/200/200 | 0.0300/0.0200/0.0400 |
| Orange TC/R2BN/B324 | 200/200/200 | 0.0235/0.0180/0.0400 |

Other ingredients utilized in the trichromatic dyeing tests set forth in this example are set out below in Table 4.

TABLE 4

OTHER INGREDIENTS

| | | | |
|---|---|---|---|
| FX657 | Stain resistant agent for nylon | 3M | St. Paul, MN |
| SR500 | Stain resistant agent for nylon | DuPont | Wilmington, DE |
| FB-50 | Reacted silicone base defoamer | Dow Corning Chemical Company | Midland, MI |

In the trichromatic dyeing tests set forth in this Example, Ahiba dyeings were performed using a dark gray shade to determine the relative rates of exhaustion for each dye. Additionally, Ahiba dyeings were performed to achieve a medium gray shade on each substrate for the xenon lightfastness testing. One of ordinary skill in the art will recognize that the Ahiba dyeing process is a small-scale laboratory simulation of the batch (or Beck) dyeing process. Generally, this process can be conducted at a liquor to goods ratio of between 14:1 and 80:1. Lightfastness was tested according to AATCC Method 16E. Results of the xenon lightfastness tests are set out below in Tables 4 and 5.

TABLE 4

XENON LIGHTFASTNESS RESULTS

| Fiber Type | Dye Selection | % E D1 | % E D2 | % E D3 | Build Deltas L | Build Deltas a | Build Deltas b | Build Deltas E | Build Deltas CMC |
|---|---|---|---|---|---|---|---|---|---|
| 1341/FS | Y199/R361/B324 | 48.8 | 40.6 | 45.2 | 3.3 | −2.16 | 2.66 | 4.76 | 4.51 |
| | OTC/R361/B324 | 53.7 | 54.5 | 54 | 2.33 | −0.39 | 0.26 | 2.38 | 1.28 |
| | YKFRL/R2BN/B324 | 48.8 | 51.9 | 48.9 | −0.1 | 1.47 | −0.47 | 1.55 | 1.96 |
| | OTC/R2BN/B324 | 53.8 | 49.8 | 52.9 | 1.04 | 1.32 | −0.93 | 1.92 | 2.16 |
| 1126/FS | Y199/R361/B324 | 54.1 | 43.1 | 48.4 | 1.6 | −2.76 | 4.16 | 5.24 | 6.08 |
| | OTC/R28N/B324 | 46.6 | 45.7 | 48 | 1.73 | −1.02 | −0.43 | 2.05 | 1.48 |
| | YKFRL/R2BN/B324 | 52.3 | 56.2 | 52.6 | −2.24 | 1.92 | −0.92 | 3.09 | 2.95 |
| | OTC/R2BN/B324 | 46.4 | 51.5 | 47.9 | 0.51 | 1.62 | −1.37 | 2.18 | 2.93 |
| 1392/Sp Tex | Y199/R361/B324 | 46.5 | 36.9 | 41.1 | 5.35 | −2.14 | 3.62 | 6.8 | 5.88 |
| | OTC/R361/B324 | 44.9 | 42.5 | 43.8 | 3.62 | −0.78 | 0.8 | 3.79 | 2.32 |
| | YKFRL/R2BN/B324 | 44.3 | 46 | 43.9 | 2.79 | 0.9 | 0.25 | 2.94 | 1.74 |
| | OTC/R2BN/B324 | 41.3 | 43.7 | 41.8 | 4.1 | 0.86 | −0.6 | 4.23 | 2.45 |
| 1500/FS | Y199/R361/B324 | 61.7 | 54.8 | 59.6 | −4.56 | −2.18 | 2.24 | 5.53 | 4.18 |
| | OTC/R361/B324 | 52.3 | 53.8 | 55.4 | −2.46 | −0.31 | −1.5 | 2.9 | 2.32 |
| | YKFRL/R2BN/B324 | 56.1 | 58 | 56.7 | −3.98 | 1.03 | −1.12 | 4.26 | 2.71 |
| | OTC/R2BN/B324 | 48.3 | 52.2 | 50.2 | −0.39 | 1.07 | −1.34 | 1.76 | 2.4 |

TABLE 4-continued

XENON LIGHTFASTNESS RESULTS

| Fiber Type | Dye Selection | % E D1 | % E D2 | % E D3 | Build Deltas L | Build Deltas a | Build Deltas b | Build Deltas E | Build Deltas CMC |
|---|---|---|---|---|---|---|---|---|---|
| 1388/Sp Tex | Y199/R361/B324 | 53.9 | 47.7 | 51.4 | −0.13 | −1.71 | 1.74 | 2.44 | 2.74 |
| | OTC/R361/B324 | 48.1 | 48.3 | 50 | 0.46 | −0.56 | −0.77 | 1.06 | 1.19 |
| | YKFRL/R2BN/B324 | 46.5 | 50 | 47.4 | 0.86 | 1.27 | −0.75 | 1.71 | 1.95 |
| | OTC/R2BN/B324 | 45.6 | 50.3 | 47.1 | 1.09 | 1.45 | −1.26 | 2.21 | 2.54 |
| 1530/Sp Tex | Y199/R361/B324 | 44.2 | 33.7 | 37.2 | 7.39 | −2.3 | 4.27 | 8.84 | 6.56 |
| | OTC/R361/B324 | 38.8 | 35.9 | 36.6 | 7.52 | −0.67 | 1.24 | 7.65 | 4 |
| | YKFRL/R2BN/B324 | 36.4 | 38.5 | 37.2 | 6.61 | 0.42 | 0.98 | 6.7 | 3.45 |
| | OTC/R2BN/B324 | 39.8 | 38.9 | 37.4 | 6.38 | 0.57 | 1.04 | 6.49 | 3.4 |
| AT312 Sue | Y199/R361/B324 | 62.4 | 42 | 54.4 | −0.37 | −6.09 | 6.8 | 9.14 | 10.23 |
| | OTC/R361/B324 | 50.7 | 46.5 | 54.3 | −0.39 | −3.13 | −0.7 | 3.23 | 3.39 |
| | YKFRL/R2BN/B324 | 54.3 | 61.3 | 56.6 | −4.56 | 2.75 | −2.43 | 5.85 | 5.33 |
| | OTC/R2BN/B324 | 51.5 | 62 | 57.3 | −4.51 | 2.41 | −3.9 | 8.43 | 6.67 |
| S1341 Sue | Y199/R361/B324 | 73.3 | 51.5 | 65.8 | −6.29 | −6.46 | 5.94 | 10.8 | 10.27 |
| | OTC/R361/B324 | 59.9 | 60.2 | 71 | −8.68 | −4.01 | −4.71 | 10.66 | 7.82 |
| | YKFRL/R2BN/B324 | 56.5 | 70.3 | 65.4 | −9.12 | 3.74 | −6.45 | 11.78 | 11.13 |
| | OTC/R2BN/B324 | 53.7 | 70.6 | 66.1 | −9.93 | 2.79 | −0.793 | 12.26 | 12.97 |
| D1385 GG | Y199/R361/B324 | 48.3 | 32.6 | 40.8 | 6.45 | −4.5 | 5.48 | 9.59 | 8.53 |
| | OTC/R361/B324 | 40.1 | 34.9 | 40 | 6.78 | −2.51 | 0.89 | 7.28 | 4.51 |
| | YKFRL/R2BN/B324 | 38.7 | 39.9 | 37.3 | 6.41 | 0.83 | 1.26 | 6.59 | 3.74 |
| | OTC/R2BN/B324 | 41 | 44.6 | 41.7 | 4.09 | 1.2 | −0.75 | 4.33 | 2.71 |
| S1838 Sup | Y199/R361/B324 | 49.2 | 32.1 | 43.5 | 5.53 | −5.3 | 5.06 | 9.18 | 9.23 |
| | OTC/R361/B324 | 40.2 | 38.4 | 45.7 | 4.7 | −3.7 | −1.71 | 6.22 | 4.86 |
| | YKFRL/R2BN/B324 | 39.5 | 46.6 | 45.6 | 2.46 | 1.01 | −2.94 | 3.95 | 4.33 |
| | OTC/R3BN/B324 | 38.8 | 46 | 4.52 | 2.91 | 0.82 | −3.74 | 4.81 | 5.57 |
| S1090 Sup | Y199/R361/B324 | 55.7 | 36.5 | 46.2 | 3.36 | −4.81 | 6.78 | 8.97 | 9.88 |
| | OTC/R361/B324 | 42 | 35.2 | 39.9 | 6.46 | −2.36 | 1.85 | 7.14 | 4.75 |
| | YKFRL/R2BN/B324 | 41.6 | 39.3 | 36 | 6.1 | 0 | 2.41 | 6.56 | 4.24 |
| | OTC/R2BN/B324 | 39.1 | 33.7 | 33.2 | 8.93 | −0.2 | 3.47 | 9.58 | 6.21 |
| D1125 Sup | Y199/R361/B324 | 54.3 | 35 | 45.1 | 4.14 | −5.04 | 6.79 | 9.42 | 10.23 |
| | OTC/R361/B324 | 43.5 | 37.7 | 42.9 | 4.97 | −2.46 | 1.12 | 5.66 | 4.03 |
| | YKFRL/R2BN/B324 | 39.6 | 39 | 37.7 | 6.34 | 0.12 | 1.61 | 6.54 | 3.73 |
| | OTC/R2BN/B324 | 39.9 | 40.3 | 39.2 | 5.63 | 0.44 | 0.23 | 5.65 | 2.78 |
| S1670 Sue | Y199/R361/B324 | 62.1 | 32.9 | 55.1 | 0.94 | −9.37 | 7.61 | 12.11 | 14.17 |
| | OTC/R361/B324 | 44.5 | 33.2 | 53.9 | 2.84 | −8.1 | −2.04 | 8.62 | 9.79 |
| | YKFRL/R2BN/B324 | 48.8 | 57.4 | 56.4 | −3.25 | 1.3 | −4.31 | 5.55 | 6.46 |
| | OTC/R2BN/B324 | 46.1 | 56.6 | 56.1 | −2.59 | 0.86 | −5.56 | 6.19 | 8.65 |
| S1838 Sue | Y199/R361/B324 | 54.2 | 22.7 | 43.6 | 7.24 | −10.11 | 9.3 | 15.53 | 16.13 |
| | OTC/R361/B324 | 41.4 | 29.8 | 49.4 | 5.15 | −8.17 | −1.36 | 9.75 | 9.28 |
| | YKFRL/R2BN/B324 | 38.5 | 45.6 | 44.9 | 2.81 | 1.11 | −3.23 | 4.42 | 4.76 |
| | OTC/R2BN/B324 | 38.7 | 46.5 | 46.4 | 2.4 | 0.77 | −4.49 | 5.15 | 6.63 |
| S1993 Sue | Y199/R361/B324 | 61.3 | 32.2 | 51.5 | 2.49 | −8.79 | 7.55 | 11.85 | 12.38 |
| | OTC/R361/B324 | 48.9 | 38.8 | 55.9 | 0.67 | −8.34 | −1.4 | 6.53 | 7.51 |
| | YKFRL/R2BN/B234 | 49.5 | 59.1 | 58.1 | 3.54 | 2.23 | −4.05 | 5.82 | 5.67 |
| | OTC/R2BN/B324 | 37.8 | 49.1 | 45.8 | −2.09 | 2.1 | −4.69 | 5.72 | 6.43 |

TABLE 5

XENON LIGHTFASTNESS TEST RESULTS UTILIZING STAINBLOCKER AT pH 2.0 and 1.5

| Stainblocker | Fiber Type | Dye Selection | pH 2.0 Deltas L | pH 2.0 Deltas a | pH 2.0 Deltas b | pH 2.0 Deltas E | PH 2.0 Deltas CMC | pH 1.5 Deltas L | pH 1.5 Deltas a | pH 1.5 Deltas b | pH 1.5 Deltas E | pH 1.5 Deltas CMC |
|---|---|---|---|---|---|---|---|---|---|---|---|---|
| 4% FX657 | 1341/FS | Y199/R361/B324 | 1.6 | −0.43 | −0.22 | 1.67 | 0.98 | 1.55 | −0.58 | −0.15 | 1.66 | 1.06 |
| | | OTC/R361/B324 | 1.12 | −0.35 | 0.03 | 1.17 | 0.72 | 1.17 | −0.29 | −0.04 | 1.21 | 0.68 |
| | | YKFRL/R2BN/B324 | 1.95 | −0.98 | 0.36 | 2.21 | 1.66 | 1.24 | −0.74 | 0.06 | 1.45 | 1.15 |
| | | OTC/R2BN/B324 | 0.83 | −0.44 | 0.07 | 0.94 | 0.75 | 1.94 | −0.52 | −0.08 | 2.01 | 1.16 |
| 4% FX657 | 1126/FS | Y199/R361/B324 | 2.33 | −0.62 | −0.5 | 2.46 | 1.52 | 1.86 | −0.84 | −0.3 | 1.99 | 1.27 |
| | | OTC/R28N/B324 | 1.63 | −0.35 | −0.06 | 1.67 | 0.93 | 0.62 | −0.22 | −0.36 | 0.75 | 0.67 |
| | | YKFRL/R2BN/B324 | 2.23 | −1.25 | 0.3 | 2.57 | 2.04 | 1.9 | −1.17 | 0.24 | 2.24 | 1.83 |
| | | OTC/R2BN/B324 | 1.5 | −0.77 | −0.07 | 1.69 | 1.31 | 1.38 | −0.58 | −0.03 | 1.5 | 1.04 |
| 4% FX667 | 1392/Sp Tex | Y199/R361/B324 | 0.52 | −0.17 | −0.7 | 0.89 | 0.97 | 1.2 | −0.31 | −0.75 | 1.45 | 1.2 |
| | | OTC/R361/B324 | 1.05 | −0.24 | −0.16 | 1.09 | 0.63 | 1.52 | −0.26 | 0.3 | 1.57 | 0.89 |
| | | YKFRL/R2BN/B324 | 0.61 | −0.5 | −0.04 | 0.79 | 0.75 | 1.73 | −0.81 | 0.22 | 1.92 | 1.36 |
| | | OTC/R2BN/B324 | 1.39 | −0.37 | −0.4 | 1.49 | 1 | 1.33 | −0.38 | −0.21 | 1.4 | 0.88 |
| 4% FX657 | 1500/FS | Y199/R361/B324 | 0.92 | −0.52 | −0.37 | 1.12 | 0.95 | 0.48 | −0.56 | −0.46 | 0.87 | 0.99 |
| | | OTC/R361/B324 | 2.47 | −0.47 | 0.5 | 2.56 | 1.51 | 2.72 | −0.85 | 0.14 | 2.8 | 1.57 |
| | | YKFRL/R2BN/B324 | 2.2 | −1.02 | 0.59 | 2.5 | 1.86 | 1.78 | −1.11 | 0.49 | 2.15 | 1.79 |
| | | OTC/R2BN/B324 | 2.96 | −0.64 | 0.35 | 3.07 | 1.75 | 0.84 | −0.66 | 0.05 | 1.07 | 1.01 |

TABLE 5-continued

XENON LIGHTFASTNESS TEST RESULTS UTILIZING STAINBLOCKER AT pH 2.0 and 1.5

| Stainblocker | Fiber Type | Dye Selection | pH 2.0 Deltas L | pH 2.0 Deltas a | pH 2.0 Deltas b | pH 2.0 Deltas E | PH 2.0 Deltas CMC | pH 1.5 Deltas L | pH 1.5 Deltas a | pH 1.5 Deltas b | pH 1.5 Deltas E | pH 1.5 Deltas CMC |
|---|---|---|---|---|---|---|---|---|---|---|---|---|
| 4% FX657 | 1388/Sp Tex | Y199/R361/B324 | 1.61 | −0.4 | −0.81 | 1.85 | 1.34 | 2.8 | −0.73 | −0.93 | 3.04 | 1.94 |
| | | OTC/R361/B324 | 1.58 | −0.31 | −0.46 | 1.67 | 1 | 2.79 | −0.5 | −0.57 | 2.89 | 1.6 |
| | | YKFRL/R2BN/B324 | 1.53 | −0.67 | −0.11 | 1.77 | 1.15 | 1.9 | −0.5 | −0.59 | 2.05 | 1.3 |
| | | OTC/R2BN/B324 | 1.32 | −0.37 | −0.7 | 1.54 | 1.18 | 2.29 | −0.5 | −0.82 | 2.48 | 1.61 |
| 4% FX657 | 1530/Sp Tex | Y199/R361/B324 | 1.54 | −0.5 | −0.29 | 1.64 | 1.03 | 1.83 | −0.48 | −0.47 | 1.95 | 1.21 |
| | | OTC/R361/B324 | 1.46 | −0.42 | 0.07 | 1.52 | 0.87 | 1.52 | −0.35 | −0.1 | 1.56 | 0.84 |
| | | YKFRL/R2BN/B324 | 1.53 | −1.16 | 0.52 | 1.99 | 1.76 | 1.93 | −0.79 | 0.03 | 2.09 | 1.38 |
| | | OTC/R2BN/B324 | 1.14 | −0.6 | −0.19 | 1.3 | 0.98 | 1.42 | −0.48 | −0.27 | 1.52 | 0.98 |
| 2% FX657 | AT312 Sue | Y199/R361/B324 | 0.27 | −001 | −1.06 | 1.09 | 1.29 | 1.17 | −0.36 | −1.12 | 1.66 | 1.56 |
| | | OTC/R361/B324 | 0.15 | 0.09 | −0.63 | 0.65 | 0.87 | 2.04 | −1.09 | −0.5 | 2.37 | 1.92 |
| | | YKFRL/R2BN/B324 | 2.63 | −0.34 | 0.19 | 2.66 | 1.31 | 1.74 | −0.93 | 0.02 | 1.97 | 1.48 |
| | | OTC/R2BN/B324 | 1.29 | −0.15 | −0.62 | 1.44 | 1.06 | 2.31 | −0.83 | −0.38 | 2.48 | 1.65 |
| 2% FX657 | S1341 Sue | Y199/R361/B324 | −0.48 | −0.04 | −0.22 | 0.53 | 0.35 | −0.59 | 0.05 | −0.74 | 0.95 | 0.97 |
| | | OTC/R361/B324 | 0.42 | −0.02 | 0.1 | 0.43 | 0.24 | −0.54 | 0.12 | −0.42 | 0.69 | 0.65 |
| | | YKFRL/R2BN/B324 | 0.78 | −0.39 | 0.27 | 0.91 | 0.72 | −0.09 | −0.42 | 0.09 | 0.44 | 0.57 |
| | | OTC/R2BN/B324 | 0 | −0.1 | −0.2 | 0.22 | 0.31 | −1.29 | −0.26 | −0.04 | 1.32 | 0.66 |
| 4% SR500 | D1385 GG | Y199/R361/B324 | 1.13 | −0.67 | −0.7 | 1.49 | 1.36 | 2.01 | −0.64 | −1.25 | 2.45 | 1.97 |
| | | OTC/R361/B324 | 1.31 | −0.47 | −0.16 | 1.4 | 0.91 | 1.81 | −0.57 | −0.46 | 1.95 | 1.29 |
| | | YKFRL/R2BN/B324 | 1.34 | −1.03 | −0.01 | 1.69 | 1.46 | 1.63 | 0.98 | −0.16 | 1.91 | 1.5 |
| | | OTC/R2BN/B324 | 1.49 | −0.67 | −0.01 | 1.63 | 1.13 | 1.5 | −0.72 | −0.58 | 1.76 | 1.38 |
| 2% FX657 | S1838 Sup | Y199/R361/B324 | 1.67 | −0.51 | −0.17 | 1.75 | 1.04 | 1.53 | −0.33 | −0.86 | 1.79 | 1.37 |
| | | OTC/R361/B324 | 1.45 | −0.27 | −0.15 | 1.43 | 0.79 | 1.73 | −0.38 | 0.01 | 1.77 | 0.94 |
| | | YKFRL/R2BN/B324 | 1.88 | −0.6 | 0.34 | 2 | 1.21 | 1.82 | −0.66 | 0.13 | 1.94 | 1.2 |
| | | OTC/R2BN/B324 | 1.74 | −0.38 | −0.05 | 1.78 | 0.95 | 1.63 | −0.29 | −0.2 | 1.67 | 0.89 |
| 2% FX657 | S1090 Sup | Y199/R361/B324 | 1.31 | −0.64 | −0.47 | 1.53 | 1.19 | 1.6 | −0.37 | −0.91 | 1.88 | 1.42 |
| | | OTC/R361/B324 | 1.36 | −0.29 | −0.34 | 1.43 | 0.87 | 2.62 | −0.49 | −0.48 | 1.32 | 1.04 |
| | | YKFRL/R2BN/B324 | 1.43 | −0.66 | −0.06 | 1.58 | 1.07 | 1.32 | −0.62 | −0.29 | 1.49 | 1.08 |
| | | OTC/R2BN/B324 | 1.2 | −0.6 | −0.19 | 1.31 | 0.9 | 1.13 | −0.49 | −0.48 | 1.32 | 1.04 |
| 2% FX657 | D1125 Sup | Y199/R361/B324 | 2.32 | −0.47 | −0.36 | 2.39 | 1.31 | 1.64 | −0.44 | −1.09 | 2.02 | 1.66 |
| | | OTC/R361/B324 | 1.59 | −0.14 | −0.2 | 1.81 | 0.78 | 1.57 | −0.19 | −0.31 | 1.61 | 0.86 |
| | | YKFRL/R2BN/B324 | 1.77 | −0.58 | 0.06 | 1.86 | 1.1 | 1.66 | −0.48 | −0.08 | 1.75 | 1.01 |
| | | OTC/R2BN/B324 | 1.99 | −0.39 | −0.13 | 2.03 | 1.08 | 1.57 | −0.37 | −0.27 | 1.64 | 0.97 |
| 2% FX657 | S1670 Sue | Y199/R361/B324 | 2.19 | 0.04 | −0.46 | 2.24 | 1.13 | 1.28 | 0.33 | −0.91 | 1.59 | 1.31 |
| | | OTC/R361/B324 | 0.42 | 0.39 | −0.89 | 1.06 | 1.38 | 1.27 | 0.46 | −1.03 | 1.7 | 1.66 |
| | | YKFRL/R2BN/B324 | 1.32 | 0.26 | −0.36 | 1.39 | 0.82 | 1.23 | 0.28 | −0.39 | 1.32 | 0.82 |
| | | OTC/R2BN/B324 | 1.18 | 0.4 | −1.04 | 1.62 | 1.57 | 2.73 | 0.95 | −1.15 | 3.11 | 2.38 |
| 2% FX657 | S1836 Sue | Y199/R361/B324 | 1.5 | 0.27 | −0.94 | 1.79 | 1.42 | 0.63 | 0.28 | −0.81 | 1.08 | 1.13 |
| | | OTC/R361/B324 | 1.58 | 0.31 | −0.44 | 1.67 | 1.07 | 1.23 | 0.19 | −0.38 | 1.3 | 0.85 |
| | | YKFRL/R2BN/B324 | 1.87 | 0.14 | −0.15 | 1.66 | 0.82 | 1.31 | 0.18 | −0.18 | 1.33 | 0.7 |
| | | OTC/R2BN/B324 | 1.37 | 0.43 | −0.81 | 1.85 | 1.48 | 1.78 | 0.4 | −0.57 | 1.89 | 1.29 |
| 2% FX657 | S1993 Sue | Y199/R361/B324 | 1.56 | 0.06 | −1.62 | 2.25 | 1.99 | 1.38 | 0.13 | −1.74 | 2.22 | 2.03 |
| | | OTC/R361/B324 | 1.59 | 0.24 | −1.79 | 2.41 | 2.3 | 1.25 | 0.27 | −1.53 | 1.99 | 1.98 |
| | | YKFRL/R2BN/B234 | 1.63 | −0.2 | −0.85 | 1.85 | 1.25 | 1.52 | −0.18 | −0.76 | 1.72 | 1.15 |
| | | OTC/R2BN/B324 | 1.75 | 0.23 | −1.85 | 2.56 | 2.39 | 1.12 | 0.16 | −1.6 | 1.96 | 1.97 |

In Tables 4 and 5, the samples analyzed for the build dyeings were removed from the dyeing machine in the temperature range between 85° F. and 113° F., depending on the fiber type, in order to capture the dye on fiber amounts in the range of 50% total exhaustion of the dyestuffs for each fiber system/dyeing system tested. All residual dyeings were processed by heating the residual dyebath to 205° F. and holding for 20 minutes.

In each of Tables 4 and 5, the "% E" values are the relative % exhaustion values for each dye system. The % E value is measured by interrupting the dyeing to examine the color build characteristics for the particular yarn system/dye combination.

In each of Tables 4 and 5, a smaller DE cmc value indicates a smaller color difference between the build dyeing and the residual dyeing. Such a smaller number indicates a more uniform exhaustion of the dyes for a particular dye formulation. Values of below 3 units are particularly preferred in the invention herein. As is apparent from Tables 4 and 5, across all fiber types, use of Orange TC as the yellow component in trichromatic dyeing processes provides a significant improvement in lightfastness. Such lightfastness improvements are surprisingly seen even when the dyed fibers are treated with stainblocker chemicals.

The invention has been described in detail with particular reference to preferred embodiments thereof, but it will be understood that substitutions, omissions, variations, modifications and other changes can be effected without departing from the scope and spirit of the invention.

What is claimed is:

1. A process for the trichromatic dyeing of polyamide textile fibers wherein the process comprises the steps of:

a. providing at least one polyamide fiber; and b. contacting the at least one polyamide fiber with an aqueous dye solution comprising a yellow component, a red component and a blue component, wherein the yellow component comprises a mixture of Acid Orange 156 and Acid Yellow 199, thereby providing a dyed fiber.

2. The process of claim 1, wherein the blue component comprises one or more of a dye selected from the group consisting of: Acid Blue 25; Acid Blue 40; Acid Blue 41, Acid Blue 78; Acid Blue 129; Acid Blue 205; Acid Blue 260; Acid Blue 277; Acid Blue 288; Acid Blue 324; Acid Green 25, or a mixture thereof.

3. The process of claim 1, wherein the red component comprises one or more of a dye selected from the group consisting of: Acid Red 42; Acid Red 57; Acid Red 257; Acid Red 266; Acid Red 337; Acid Red 361; Acid Red 396; Acid Red 426, or a mixture thereof.

4. The process of claim 1, wherein the yellow component further comprises one or more of a dye selected from the group consisting of Acid Yellow 49; Acid Yellow 135; Acid Yellow 159; Acid Yellow 159:1; Acid Yellow 174; Acid Yellow 198; Acid Yellow 216; Acid Yellow 219:1; Acid Yellow 230; Acid Yellow 240; Acid Orange 47; Acid Orange 67; Acid Orange 116; Acid Orange 152, or a mixture thereof.

5. The process of claim 1, wherein the yellow component comprises from about 20 part to about 80 parts of Acid Orange 156 and from about 20 parts to about 80 parts of Acid Yellow 199 to provide 100 total parts dye in the yellow component.

6. The process of claim 1, wherein the yellow component comprises from about 48 parts to about 52 parts of Acid Orange 156 and from about 48 parts to about 52 parts of Acid Yellow 199 to provide 100 total parts dye in the yellow component.

7. The process of claim 2, wherein the blue component comprises Acid Blue 324.

8. The process of claim 3, wherein the red component comprises Acid Red 337, Acid Red 426, Acid Red 361, or a mixture thereof.

9. The process of claim 1, wherein the aqueous dye solution further comprises one or more of a wetting agent, a leveling agent, a buffering agent, a lightfastness enhancing agent and a water treatment agent.

10. The process of claim 1, wherein the trichromatic dyeing process is conducted in a continuous process.

11. The process of claim 1, wherein the trichromatic dyeing process is conducted in a batch dyeing process.

12. The process of claim 1, wherein the aqueous dye solution contains an amount of the yellow, red, and blue components effective to provide a dye take up of from about 0.0001% owf to about 2.0% owf for each of the yellow, red and blue components.

13. A composition for dyeing polyamide fibers, wherein the composition comprises a yellow component, a red component and a blue component and wherein the yellow component comprises a mixture of Acid Orange 156 and Acid Yellow 199.

14. The composition of claim 13, wherein the blue component comprises one or more of a dye selected from the group consisting of: Acid Blue 25; Acid Blue 40; Acid Blue 41, Acid Blue 78; Acid Blue 129; Acid Blue 205; Acid Blue 260; Acid Blue 277; Acid Blue 288; Acid Blue 324; Acid Green 25, or a mixture thereof.

15. The process of claim 13, wherein the red component comprises one or more of a dye selected from the group consisting of: Acid Red 42; Acid Red 57; Acid Red 257; Acid Red 266; Acid Red 337; Acid Red 361; Acid Red 396; Acid Red 426, or a mixture thereof.

16. The composition of claim 13, wherein the yellow component further comprises one or more of a dye selected from the group consisting of Acid Yellow 49; Acid Yellow 135; Acid Yellow 159; Acid Yellow 159:1; Acid Yellow 174; Acid Yellow 198; Acid Yellow 216; Acid Yellow 219:1; Acid Yellow 230; Acid Yellow 240; Acid Orange 47; Acid Orange 67; Acid Orange 116; Acid Orange 152, or a mixture thereof.

17. The composition of claim 13, wherein the yellow component comprises from about 80 part to about 20 parts of Acid Orange 156 and from about 20 parts to about 80 parts of Acid Yellow 199 to provide 100 total parts dye in the yellow component.

18. The composition of claim 13, wherein the yellow component comprises from about 48 parts to about 52 parts of Acid Orange 156 and from about 48 parts to about 52 parts of Acid Yellow 199 to provide 100 total parts dye in the yellow component.

19. The composition of claim 14, wherein the blue component comprises Acid Blue 324.

20. The composition of claim 15, wherein the red component comprises Acid Red 337, Acid Red 426, or a mixture thereof.

21. The composition of claim 13, wherein the aqueous solution further comprises one or more of a wetting agent, a leveling agent, a buffering agent, a lightfastness enhancing agent and a water treatment agent.

* * * * *